US008276775B2

(12) United States Patent
Boukobza

(10) Patent No.: US 8,276,775 B2
(45) Date of Patent: Oct. 2, 2012

(54) CONTAINER WITH AT LEAST ONE GROOVE OF VARIABLE DEPTH

(75) Inventor: Michel Boukobza, Octeville-sur-Mer (FR)

(73) Assignee: Sidel Participations, Octeville sur Mer (FR)

( * ) Notice: Subject to any disclaimer, the term of this patent is extended or adjusted under 35 U.S.C. 154(b) by 511 days.

(21) Appl. No.: 12/483,594

(22) Filed: Jun. 12, 2009

(65) Prior Publication Data

US 2010/0012618 A1 Jan. 21, 2010

(30) Foreign Application Priority Data

Jun. 16, 2008 (FR) ..... 08 53957

(51) Int. Cl.
*B65D 1/42* (2006.01)

(52) U.S. Cl. ..... 215/381; 215/383; 220/672; 220/675

(58) Field of Classification Search ..... 215/379, 215/382–384, 381; 220/672, 675, 669, 671, 220/673
See application file for complete search history.

(56) References Cited

U.S. PATENT DOCUMENTS

| | | | | |
|---|---|---|---|---|
| 3,225,950 | A * | 12/1965 | Fulcher et al. | 215/384 |
| 3,708,082 | A | 1/1973 | Platte | |
| 5,381,910 | A * | 1/1995 | Sugiura et al. | 215/398 |
| 5,499,730 | A * | 3/1996 | Harbour | 215/382 |
| 5,632,397 | A * | 5/1997 | Fandeux et al. | 215/382 |
| 5,746,339 | A * | 5/1998 | Petre et al. | 215/383 |
| 6,527,133 | B1 | 3/2003 | McCollum et al. | |
| 6,752,284 | B1 * | 6/2004 | Akiyama et al. | 215/379 |
| 7,032,770 | B2 * | 4/2006 | Finlay et al. | 220/669 |
| 7,080,747 | B2 * | 7/2006 | Lane et al. | 215/381 |
| 2003/0010743 | A1 * | 1/2003 | Boukobza | 215/382 |
| 2003/0015491 | A1 * | 1/2003 | Melrose et al. | 215/381 |
| 2005/0218108 | A1 * | 10/2005 | Bangi et al. | 215/384 |
| 2006/0108317 | A1 | 5/2006 | Tanaka et al. | |
| 2006/0261030 | A1 | 11/2006 | Manderfield, Jr. | |
| 2008/0093331 | A1 * | 4/2008 | Roubal et al. | 215/382 |
| 2010/0102024 | A1 * | 4/2010 | Shimamoto et al. | 215/384 |

FOREIGN PATENT DOCUMENTS

| | | | |
|---|---|---|---|
| EP | 0 437 620 | A1 | 7/1991 |
| FR | 2 132 101 | A | 11/1972 |
| GB | 2 025 889 | A | 1/1980 |
| GB | 2161133 | A * | 1/1986 |
| JP | 10-236450 | A | 9/1998 |

OTHER PUBLICATIONS

French Preliminary Search Report for FR 0853957 dated Dec. 11, 2008.
European Search Report for EP 09 16 2605 dated Sep. 23, 2009.

* cited by examiner

*Primary Examiner* — Sue Weaver
(74) *Attorney, Agent, or Firm* — Sughrue Mion, PLLC

(57) ABSTRACT

Container, made of a thermoplastic such as PET, having a body oriented along a longitudinal axis with a wall enclosing the axis defining two faces separated from each other by two connecting regions. The body is provided with one groove extending partly over the two faces of the body and one of the two connecting regions, wherein the one groove extends approximately in a plane at right angles to the axis of the body with a depth which is variable between a first depth P1 in the two faces of the body and a second depth P2 in the connecting region. The ratio P1/P2 between the two depths is between zero and a value less than or equal to 0.5.

15 Claims, 6 Drawing Sheets

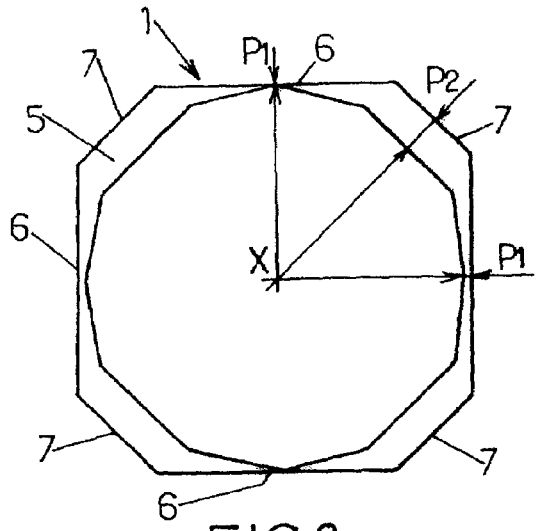
FIG.8.
FIG.9.
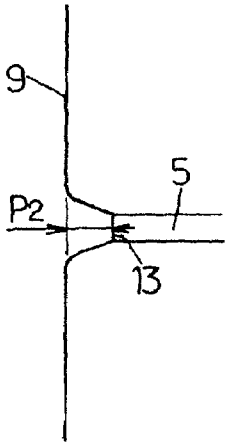
FIG.10.
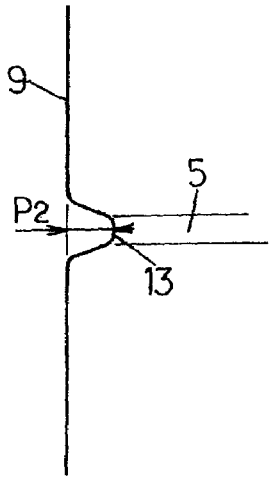
FIG.11.
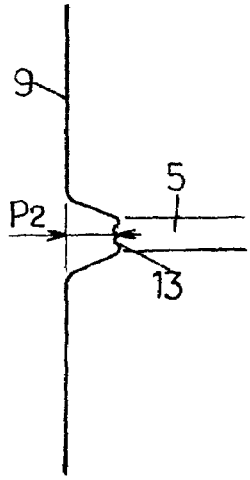

CONTAINER WITH AT LEAST ONE GROOVE OF VARIABLE DEPTH

FIELD OF THE INVENTION

This invention relates in general terms to containers, especially bottles, made of a thermoplastic such as PET (polyethylene terephthalate), and relates more specifically to improvements to those of these containers which comprise a body oriented along a longitudinal axis with a wall enclosing the axis and defining at least two faces separated from each other by at least two connecting regions, the body being provided with at least one groove extending partly over the two faces of said body and over at least one of the two connecting regions.

DESCRIPTION OF THE PRIOR ART

When filled, containers of the kind specified are very stiff, leaving them unable to withstand without damage even very limited external or internal forces. This occurs for example when too many containers are stacked on top of each other (typically packs of bottles stacked on pallets), which can cause crumpling of the plastic wall. Even if the wall does actually break and there is therefore no fluid leak, and hence the contents of the container could be used, customers almost always reject such damaged containers and they become unsaleable.

Another and more important point is that when this sort of container is filled with a hot liquid and then closed, the volume of air trapped inside the container shrinks slightly as it cools. This typically happens with containers filled in high-speed filling installations, where the containers are closed well before the liquid, which is poured in hot, has cooled to the ambient temperature. As a result, the shrinkage of the volume of air as it cools down leaves the internal volume of the container in a state of partial vacuum.

In order for the container to be able to withstand this partial vacuum without deforming, it must have sufficient mechanical stiffness, which means for example having thick walls; in other words, such a container requires a greater amount of raw materials and is therefore more expensive—which is unacceptable to manufacturers of packaged liquids.

It is true that it is prior art to make containers in which the body is specially configured (the paneled body) to withstand this partial vacuum without apparent deformation. However, these specially shaped containers are substantially more expensive than conventional containers. If on the other hand the container is too weak, it will deform uncontrollably, and once again its poor appearance will make it difficult to sell.

Additionally, it is more difficult to prevent deformation of a container from its initial shape when the container comprises a body oriented along a longitudinal axis with a wall enclosing said axis and defining at least two faces separated from each other by at least two connecting regions (in other words, the container has several faces bounded relative to each other by corner regions, which may be sharp or rounded). An example would be a generally square container which would be liable to deform into a lozenge shape.

To solve this problem, it is prior art to provide at least one groove extending partly over the faces of the body and over the connecting regions.

One embodiment of a container 1 with such a transverse groove according to the prior art is illustrated in FIG. 1, the container 1' having a body 2' oriented along a longitudinal axis X and limited at the bottom by a base 3 and at the top by a part comprising a shoulder 4A leading to a neck 4B.

A groove 5' whose peripheral extent is closed on itself and extends in a plane approximately at right angles to the longitudinal axis X of the body 2' is formed in the body 2'.

FIGS. 2 to 4 show various possible embodiments of the groove 5' in a top view of the container 1' in cross section transversely on the central plane A-A of the groove 5', as illustrated in FIG. 1, this plane A-A passing through the base of the groove 5'.

In a first embodiment of the groove 5' illustrated in FIG. 2, it will be seen that the body 2', which is generally square, has four faces 6' separated from each other by a connecting region 7' forming a bevel-edged angular sector 10'. Thus, in a transverse cross section through the body 2' of the container l', the depth P1' separating the outer wall 9' of the body 2' from the base 8' of the groove 5' along a straight line at right angles to the longitudinal axis X and passing approximately through the middle of the face 6' of the body 2', and the depth P2' separating the outer wall 9' of the body 2' from the base 8' of the groove 5' along a straight line at right angles to the longitudinal axis X and passing approximately through the middle of the connecting region 7' are measured. It should be pointed out here that, in the embodiment illustrated in FIG. 2, the depth P1' is identical to the depth P2'.

However, it has been observed that this embodiment does not protect the initial shape of the connecting region 7' in the event of impacts as well as it does in the event of hot filling of the container 1'.

It would clearly be an advantage to protect the initial shape of this connecting region 7' to allow for the possibility of subsequent use of the container.

It would also be a particular advantage if a container could be made in which the area of deformation of the container can vary.

SUMMARY OF THE INVENTION

To this end, the present invention relates to a container having the features set out in claim 1.

Advantageously, such a container shrinks by for example 15 ml when filled with a liquid at 85° C. and by for example 18 ml when filled with this same liquid at 92° C.

Advantageously, such a container is adaptable to the constraints of the liquid production process, which constraints sometimes require the container to be filled with a liquid at varying temperatures.

BRIEF DESCRIPTION OF THE DRAWINGS

The present invention will now be described with the help of what are purely illustrative examples which in no way represent restrictions on the scope of the invention, and with reference to the appended drawings, in which:

FIG. 8 is a top view of an alternative embodiment of a groove for a container according to the invention seen in cross section at the level of the groove; and FIGS. 9-11 show various views in axial section through a number of embodiments of the base of the groove according to the invention.

DETAILED DESCRIPTION OF THE INVENTION

Figure 3:
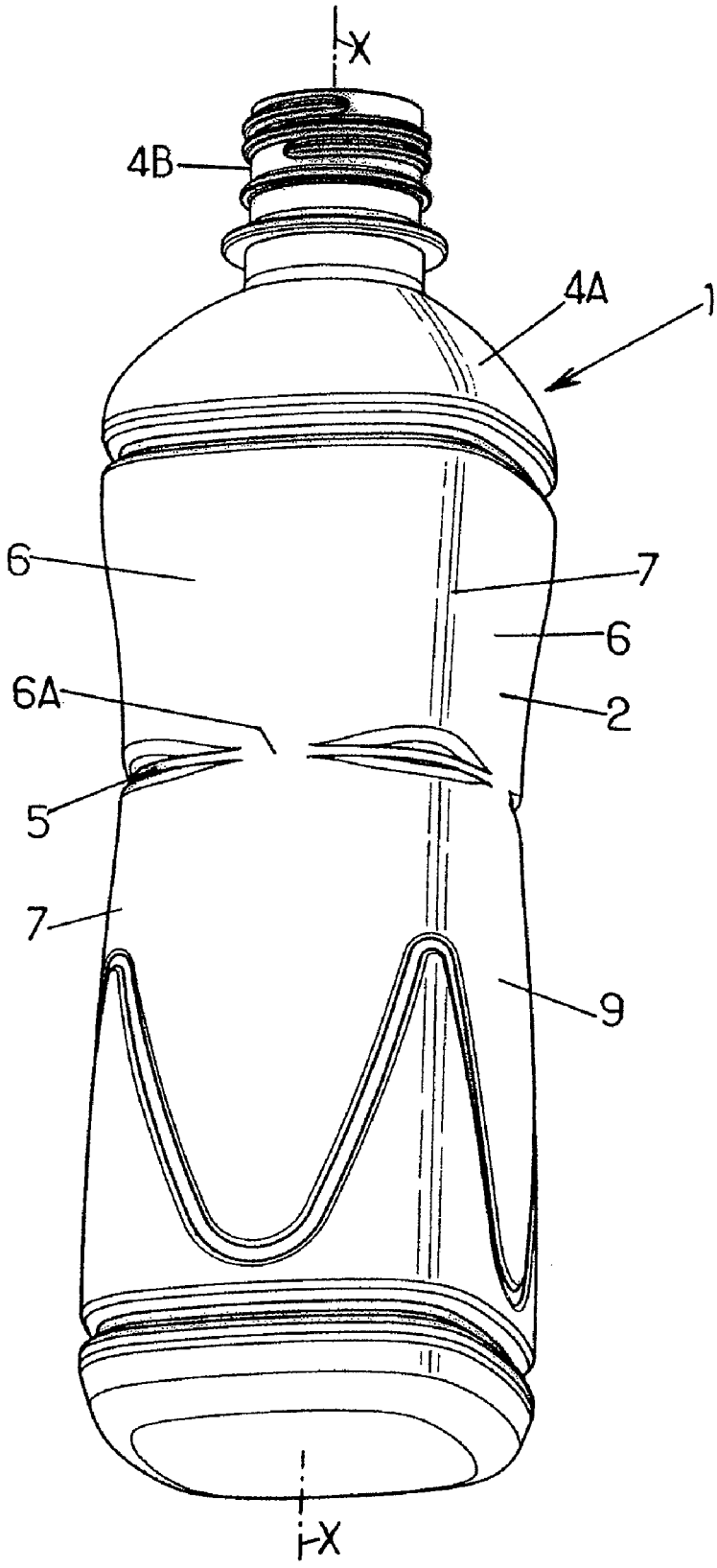
FIG. 3 is a perspective view of a first embodiment of a container according to the invention.

FIG. 3 is a perspective view of an embodiment of a container 1 according to the invention, especially a bottle, in a thermoplastic material such as PET, comprising a body 2 oriented along a longitudinal axis X and limited at the bottom by a base 3 and at the top by a shoulder 4*a* leading to a neck 4B.

The body 2 has a wall 9 enclosing the axis X and defining at least two faces 6 separated from each other by at least two connecting regions 7, the body 2 being provided with at least one groove 5 extending partly across at least two faces 6 of the body 2 and at least one of the two connecting regions 7.

Figure 4:
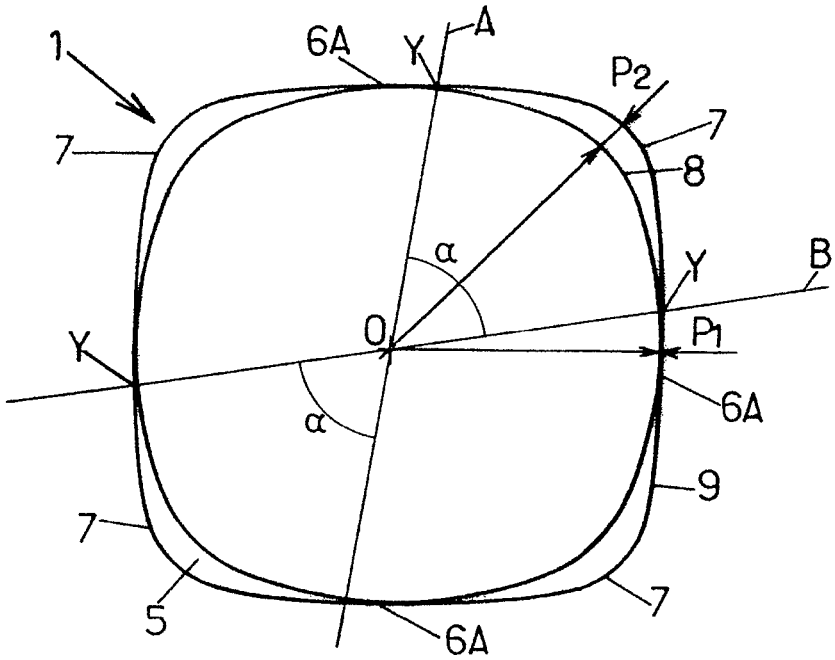
FIG. 4 is a top view of an embodiment of a groove for a container according to the invention seen in cross section at the level of the groove.
Figure 5:
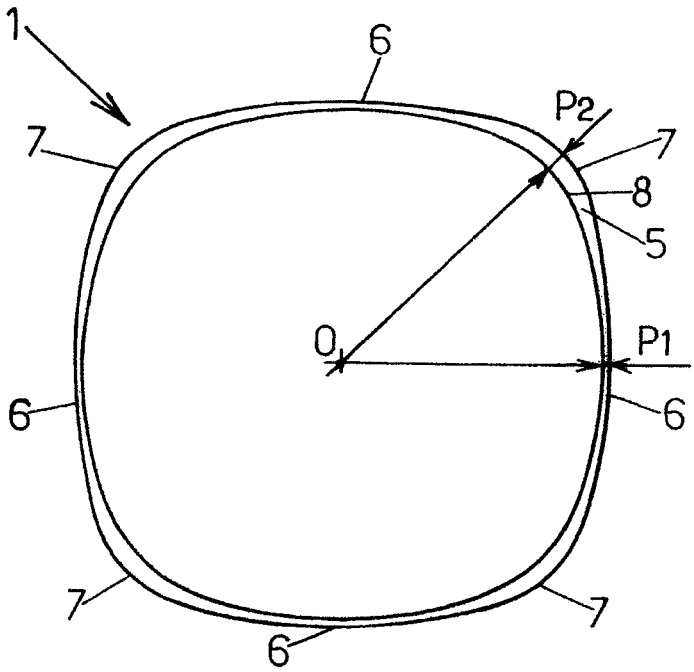
FIG. 5 is a top view of another embodiment of a groove for a container according to the invention seen in cross section at the level of the groove.

As shown more clearly in FIGS. 4 and 5, which show two cross sections through two possible embodiments of a groove 5 according to the invention, the groove 5 extends approximately in a plane at right angles to the axis X of the body with a depth that is variable between a first depth P1 on the two faces 6 of the body and a second depth P2 in the connecting region 7, the ratio P1/P2 between the two depths being between zero (in which case the first depth P1 is zero) and a value less than or equal to 0.5.

More precisely, the value of P1 is zero in the embodiment shown in FIGS. 3 and 4. In this case the groove 5, whose peripheral extent is closed on itself, is interrupted at least locally in regions 6A of the faces 6 of the container 1.

The groove 5 comprises in this case four groove segments. Each groove segment extends through an angular interval $\alpha$ of between 40° and 80°. Each angular interval $\alpha$ is bounded by two straight lines A and B belonging to a plane at right angles to the longitudinal axis X. The straight lines A and B each pass through the longitudinal axis X and through a point Y belonging both to the tangent to the curve defining the base 8 in the transverse plane shown in FIG. 4, and to the tangent to the curve defining the region 6A in this same plane.

In FIG. 4, only two angular intervals $\alpha$ have been shown to simplify the figure.

In the embodiment shown in FIG. 5, the value for the depth P1 of the groove 5 is very small over the faces 6 of the body 2 and is in a ratio such that P1/P2<1/2.

Thus, owing to the ratio of proportion of these depths P1 and P2, the connecting regions 7 are strengthened. As a result, the latter do not deform either in the event of impacts or as a result of filling the container 1 with hot contents. Moreover, as was indicated in the description of embodiments of grooves according to the prior art, the depth P1 separating the outer wall 9 of the body 2 from the base 8 of the groove 5 is measured on a straight line at right angles to the longitudinal axis X passing approximately through the middle of the face 6 of the body 2, while the depth P2 separating the outer wall 9 of the body 2 from the base 8 of the groove 5 is measured on a straight line at right angles to the longitudinal axis X and passing approximately through the middle of the connecting region 7.

In the embodiments depicted in FIGS. 4 and 5, the depth 8 of the groove 5 varies at an approximately constant rate of growth between the minimum value P1 and the maximum value P2.

The first derivative of the ratio P2/P1 is approximately constant and other than 1. The grooves 5 thus define a region 6A of variable deformation of the container 1.

Such a container 1 advantageously accepts a region 6A of deformation that varies for example as a function of the pressure applied to the walls 9 of the container. Thus, when the pressure applied to the wall 9 is low, only the region 6A deforms. In contrast, when a greater pressure is applied to the wall 9, the region 6A and part of the groove segments 5 deform. In particular, those parts of the groove segments which are shallow deform.

Figure 6:
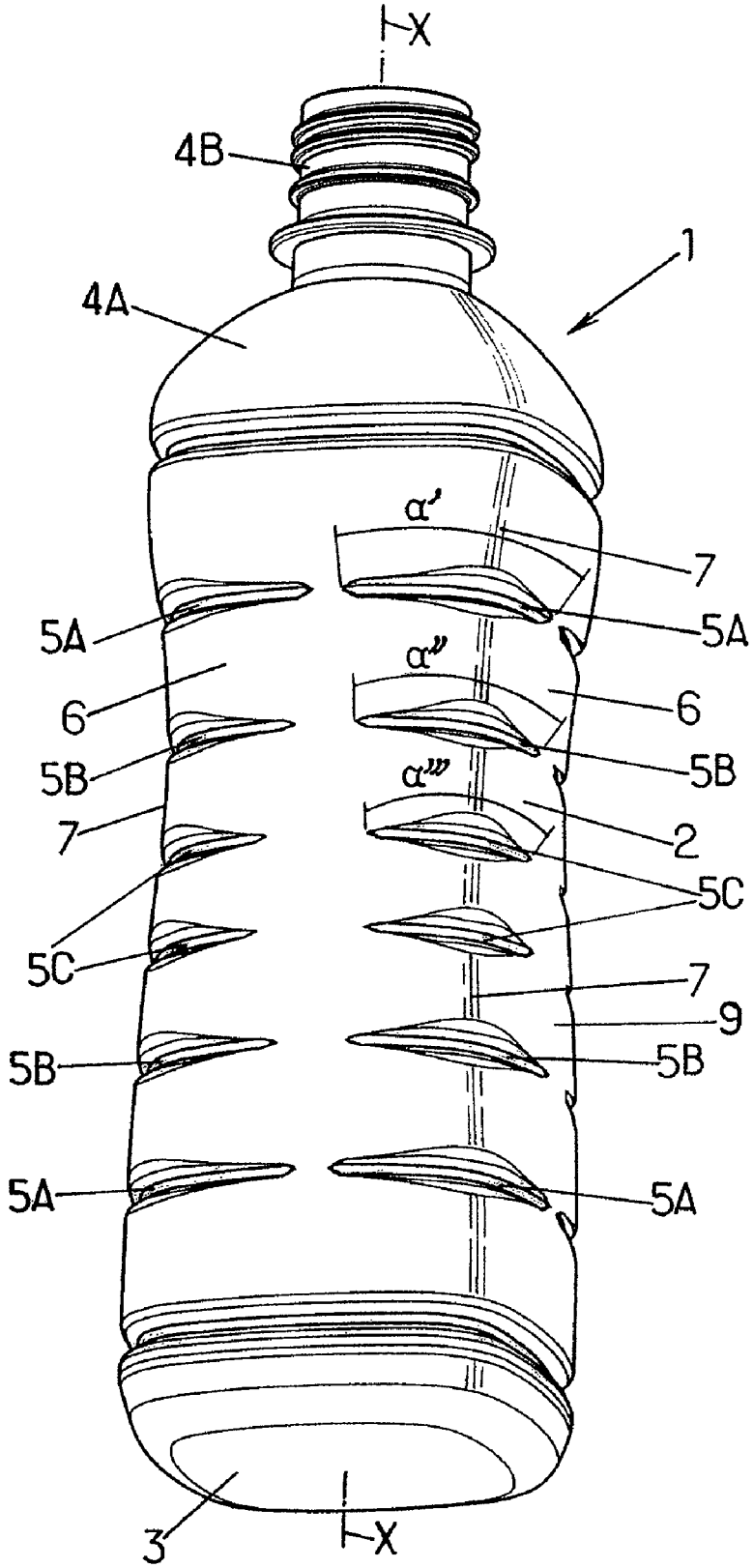
FIG. 6 is a perspective view of an alternative embodiment of a container whose body has several grooves according to the invention.

FIG. 6 is a perspective view of a container 1 comprising two first grooves 5A, two second grooves 5B, and two third grooves 5C, all formed in six different planes and all at right angles to the axis X of the container 1.

The two first grooves 5A lie between the neck 4B and the base 3, one near the neck 4B and the other near the base 3.

The two second grooves 5B lie between the two first grooves 5A. The second grooves 5B occupy a smaller angular interval $\alpha''$ than the angular interval $\alpha'$ of the first grooves 5A.

Lastly, the two third grooves 5C lie between the two second grooves 5B. The third grooves 5C occupy a smaller angular interval $\alpha'''$ than the angular interval $\alpha''$ of the second grooves 5B.

Figure 7:
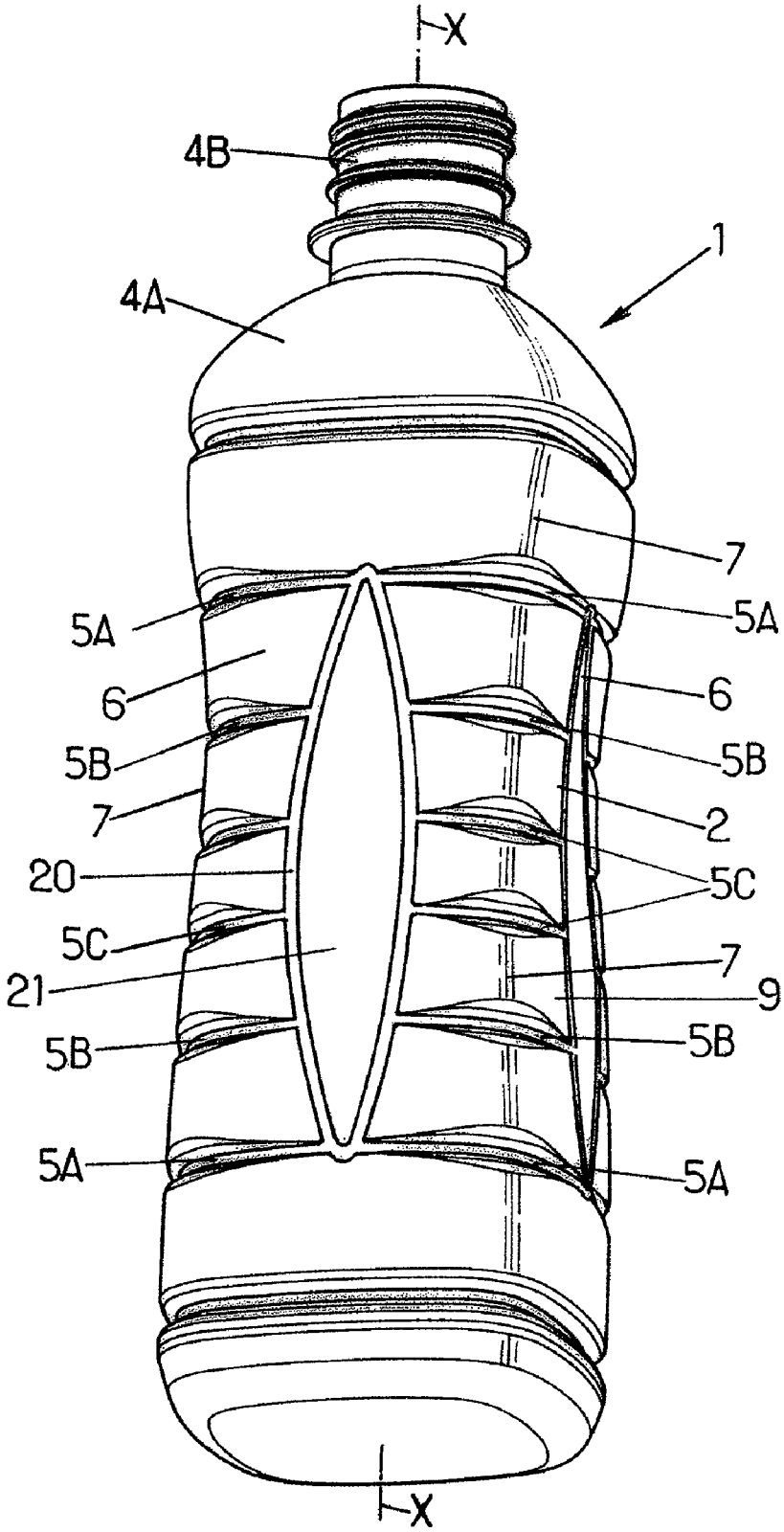
FIG. 7 is perspective view of an alternative embodiment of a container whose body has an extra groove of elongate shape.

The embodiment of the invention shown in FIG. 7 is similar to that shown in FIG. 6. Parts that are identical in both embodiments will not be described again.

The face 6 of the container 1 illustrated in FIG. 7 also comprises an extra groove 20 of elongate shape, the outer edge of which reaches the ends of the first grooves 5A, the second grooves 5B and the third grooves 5C. In particular, the extra groove 20 is roughly lozenge-shaped. This extra groove 20 forms a closed loop on the face 6 which extends along the longitudinal axis X and defines a central deformation region 21 of the container.

As a variant, the angular intervals $\alpha'$, $\alpha''$, $\alpha'''$ of the first grooves 5A, second grooves 5B and third groves 5C are identical, and the extra groove 20 is roughly rectangular in shape.

The body 2 of the container 1 preferably has four faces 6 which form in general terms, seen in a cross section at right angles to the axis X, an approximately square or rectangular section.

Figure 1:
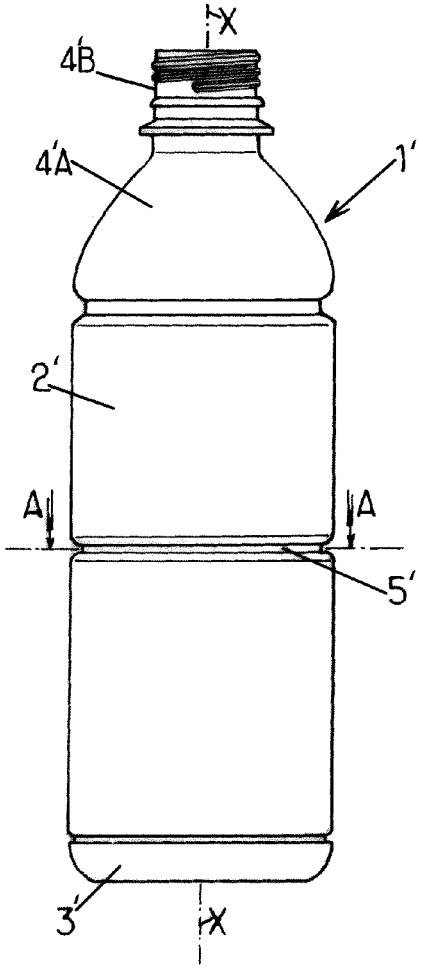
(PRIOR ART) FIG.1.
FIG. 1 is a schematic view of a prior art container.
Figure 2:
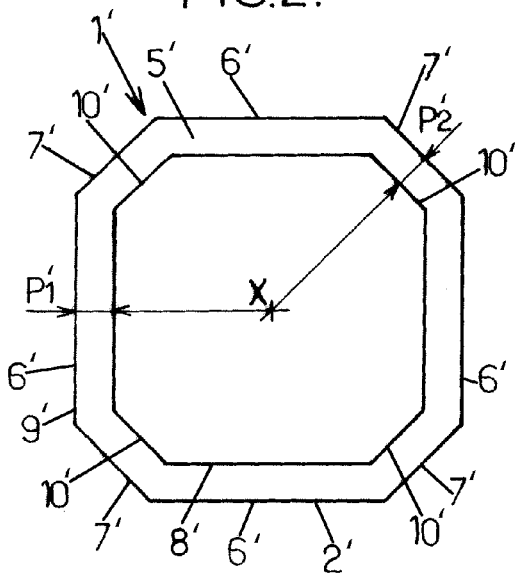
FIG. 2 is a top view of a first embodiment of a groove of a prior art container seen in cross section at the level of the groove.

The connecting region 7 advantageously forms a round-edged or slightly rounded angular region. However, the connecting region 7 may also comprise a bevel-edged angular region (as in the embodiments shown in FIGS. 2-4). Similarly the connecting region 7 may take the form of an angular sector with a pointed vertex (in which case the second depth P2 of the groove in this connecting region 7 is measured as the distance between the base of the groove 5 and the vertex of this angular sector).

The container 1 according to the invention therefore has at least one groove 5 whose depth is continually variable between a minimum value P1 in the faces 6 of the body 2 and a maximum value P2 in the connecting region 7.

FIG. 8 is a cross-sectional view through an alternative embodiment of a groove 5 according to the invention in which the depth P1 has one and the same value for the mutually opposite faces 6 of the container 1, the container 1 having a generally square body 2. Thus, in this embodiment, the first depth P1 may have different values for one and the same groove 5, specifically a value adapted for each face 6 of the body 2 of the container 1.

It will be understood that while the preferred embodiment of the invention applies to a square or rectangular container 1, the general principle of the invention applies to any type of container that has connecting regions 7 between two adjacent faces 6 and where the object is to protect the shape of this connecting region 7. Consequently the general provisions of the invention also apply to a container whose view in cross section is oval, the container 1 having in this case exactly two faces 6 and two connecting regions 7.

It should be observed here that the general provisions of the invention apply regardless of the shape of the base 13 of the groove 5. Thus, FIG. 9 is a partial view in axial section through a groove 5 according to the invention with an approximately flat base 13, FIG. 10 a partial view in axial section through a groove 5 according to the invention with a generally rounded base 13, and FIG. 11 a partial view in axial section through a groove 5 according to the invention with a base 13 with undulations.

It will be understood that the general provisions of the invention apply to grooves extending generally peripherally, as shown, but not closed on themselves. In this case, the grooves 5 may extend across only two adjacent faces 6 of a container, to either side of a connecting region 7 joining them together.

The invention claimed is:

1. Container made of a thermoplastic, comprising a body oriented along a longitudinal axis with a wall enclosing said axis and defining at least two faces separated from each other by at least two connecting regions, said body being provided with at least one groove extending partly over said at least two faces of said body and at least one of the two connecting regions, said at least one groove extending approximately in a plane at right angles to said axis of said body through a predefined angular interval, and the depth of said groove being variable between a first depth P1 in said two faces of the body and a second depth P2 in said connecting region, the ratio P1/P2 between the two depths being between zero and a maximum value, said maximum value being less than or equal to 0.5, wherein said groove has a depth P2 that varies at an approximately constant rate of growth between zero in the faces of the body and a maximum value in the connecting region.

2. Container according to claim 1, wherein a first derivative of the ratio P1/P2 is approximately constant and other than 1.

3. Container according to claim 1, wherein it comprises:

at least one first groove extending approximately in a first plane at right angles to said longitudinal axis, said first groove being located between a neck and a base of the container, and at least one second groove extending approximately in a second plane at right angles to said longitudinal axis, said second groove being located between the first groove and the base of the container;

the first groove extending through an angular interval greater than the angular interval of the second groove.

4. Container according to claim 3, wherein it comprises at least one third groove extending approximately in a third plane at right angles to said longitudinal axis, said third groove being located between the second groove and the base of the container; the third groove extending through an angular interval greater than the angular interval of the second groove.

5. Container according to claim 3, wherein the angular intervals are between 40° and 80°.

6. Container according to claim 3, wherein at least one face has at least one extra groove suitable for defining a closed region of deformation of the container; said extra groove being generally elongate and of a longitudinal axis approximately parallel to the longitudinal axis of said body, the extra groove being adjacent to the ends of at least the first groove and the second groove.

7. Container according to claim 1, wherein at least one face has at least one extra groove suitable for defining a closed region of deformation of the container; said extra groove being generally elongate and of a longitudinal axis approximately parallel to the longitudinal axis of said body.

8. Container according to claim 1, wherein said connecting region forms a round-edged angular region.

9. Container according to claim 1, wherein the first depth P1 is zero.

10. Container according to claim 1, wherein said at least one groove has a generally flat base.

11. Container according to claim 1, wherein said at least one groove has a generally rounded base.

12. Container according to claim 1, wherein said at least one groove has an undulating base.

13. The container according to claim 1, wherein the container is a bottle.

14. The container according to claim 1, wherein the container is made of PET.

15. A container made of a thermoplastic, comprising a body oriented along a longitudinal axis with a wall enclosing said axis and defining at least two faces separated from each other by at least two connecting regions, said body provided with at least first and second grooves extending partly over said at least two faces of said body and at least one of the two connecting regions, said at least first and second grooves extending approximately in a plane at right angles to said axis of said body through a predefined angular interval, and a depth of said at least first and second grooves is variable between a first depth P1 in said two faces of the body and a second depth P2 in said connecting region, the ratio P1/P2 between the two depths being between zero and a maximum value, said maximum value being less than or equal to 0.5, wherein said at least first and second grooves have a depth P2 that varies at an approximately constant rate of growth between a minimum value in the faces of the body and a maximum value in the connecting region; at least one face having at least one extra groove suitable for defining a closed region of deformation of the container; said extra groove being generally elongate and of a longitudinal axis approximately parallel to the longitudinal axis of said body, the outer edge of the extra groove reaching the ends of at least the first groove and the second groove.

* * * * *